US008771104B2

(12) United States Patent
Sato et al.

(10) Patent No.: US 8,771,104 B2
(45) Date of Patent: Jul. 8, 2014

(54) GOLF BALL

(75) Inventors: Katsunori Sato, Chichibushi (JP); Takuma Nakagawa, Chichibushi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 123 days.

(21) Appl. No.: 13/114,740

(22) Filed: May 24, 2011

(65) Prior Publication Data

US 2012/0302378 A1 Nov. 29, 2012

(51) Int. Cl.
*A63B 37/12* (2006.01)
*A63B 37/14* (2006.01)

(52) U.S. Cl.
USPC ..... 473/378; 473/384

(58) Field of Classification Search
None
See application file for complete search history.

(56) References Cited

U.S. PATENT DOCUMENTS

| | | | | |
|---|---|---|---|---|
| 4,869,512 | A * | 9/1989 | Nomura et al. | 473/383 |
| 7,229,363 | B2 * | 6/2007 | Kasashima | 473/379 |
| 7,241,233 | B2 * | 7/2007 | Sato et al. | 473/383 |
| 7,252,601 | B2 * | 8/2007 | Sato et al. | 473/383 |
| 7,390,272 | B2 * | 6/2008 | Kasashima et al. | 473/383 |
| 7,455,602 | B2 * | 11/2008 | Sato et al. | 473/383 |
| 7,534,175 | B2 * | 5/2009 | Sato et al. | 473/383 |
| 7,559,857 | B2 * | 7/2009 | Sato et al. | 473/383 |
| 8,002,647 | B2 * | 8/2011 | Sato | 473/383 |
| 2002/0077198 | A1 * | 6/2002 | Sajima | 473/378 |
| 2002/0173385 | A1 * | 11/2002 | Shannon et al. | 473/378 |
| 2003/0171167 | A1 * | 9/2003 | Kasashima | 473/378 |
| 2005/0090335 | A1 * | 4/2005 | Kennedy, III | 473/383 |
| 2005/0239579 | A1 * | 10/2005 | Sato et al. | 473/378 |
| 2006/0068939 | A1 * | 3/2006 | Sato et al. | 473/378 |
| 2006/0229142 | A1 * | 10/2006 | Simonds et al. | 473/371 |
| 2008/0004136 | A1 * | 1/2008 | Kasashima et al. | 473/378 |
| 2008/0020866 | A1 * | 1/2008 | Simonds et al. | 473/384 |
| 2010/0216575 | A1 * | 8/2010 | Sato et al. | 473/383 |

FOREIGN PATENT DOCUMENTS

| | | | |
|---|---|---|---|
| JP | 2005-305152 | A | 11/2005 |
| JP | 2006-095281 | A | 4/2006 |

* cited by examiner

*Primary Examiner* — Gene Kim
*Assistant Examiner* — John E Simms, Jr.
(74) *Attorney, Agent, or Firm* — Sughrue Mion, PLLC

(57) ABSTRACT

The invention provides a golf ball having, on a surface thereof, a plurality of circular dimples, a plurality of non-circular dimples, and a land area which is a non-dimple region composed of a plurality of arcuate first lands, each formed along an edge of one of the circular dimples, and a plurality of second lands, each arranged so as to bridge between two neighboring circular dimples and having a shape that is recessed at a center portion thereof. The non-circular dimples have an edge shape defined by a plurality of the first lands in combination with a plurality of the second lands. In this golf ball, by fashioning the lands on the ball surface into a unique shape, the surface area of the lands is minimized and the dimple surface coverage is made even larger, increasing the aerodynamic performance and thus enabling the ball to travel even farther.

14 Claims, 20 Drawing Sheets

PRIOR-ART EXAMPLE

PRIOR-ART EXAMPLE

PRIOR-ART EXAMPLE

PRIOR-ART EXAMPLE

GOLF BALL

BACKGROUND OF THE INVENTION

The present invention relates to a golf ball in which the flight performance has been improved by designing the dimples and lands formed on the surface of the ball in unique shapes.

In golf balls, it is well-known that, in order for a launched ball to travel a long distance, it is important for the ball itself to have a high rebound and for the air resistance during flight to be reduced by dimples arranged on the surface of the ball. Various methods for arranging the dimples uniformly and in the highest possible density in order to reduce air resistance have been disclosed.

As shown in FIGS. 18 and 19, it is generally common for the dimples D used on a golf ball to be in the shape of circular recesses as seen from above. Attempts to arrange circular dimples to a high density, such as by making the width of the land dividing two neighboring dimples as close to zero as possible, result in the formation of triangular or quandrangular lands t of a given size in areas surrounded by three or four of the arranged dimples. At the same time, because it is essential to arrange the dimples as uniformly as possible on the spherical surface of the ball, some concessions have had to be made when it comes to the density in which circular dimples are arranged.

In light of the above, to arrange the dimples uniformly and to a high density, from two to five types of dimples of differing diameter are disposed in such a way as to give the spherical surface of the ball the appearance of a polyhedron such as a regular octahedron or a regular icosahedron.

However, so long as circular dimples are used, the practical upper limit in the dimple surface coverage, defined as the ratio of the sum of the individual dimple surface areas to the total surface area of the spherical surface, is about 75% (that is, the surface coverage represented by the land surface areas collectively is about 25%).

In this connection, numerous disclosures have been made recently which attempt to increase the aerodynamic performance of the ball, both by using dimples having non-circular surface shapes, such as elliptical, teardrop or polygonal shapes, and in particular by combining such dimples with circular dimples to create a unique dimple configuration on the ball as a whole, and also by making the surface area of the lands on the ball surface as small as possible. Of these, the present applicant earlier disclosed JP-A 2006-095281 and JP-A 2005-305152.

As shown in FIGS. 16 and 17, the golf balls in the foregoing disclosures, along with having numerous circular dimples D1 formed on the ball surface, have circular ring-like lands 51 formed along edges of the circular dimples D1, and additionally have rectilinear lands 52 formed so as to bridge between different circular ring-like lands 51, 51. In addition, non-circular dimples D2 are formed between three or four mutually neighboring circular dimples D1 in such a way as to be surrounded by the lands.

The foregoing golf balls do enable the land surface area to be made smaller than in conventional golf balls. However, in order to considerably enhance the flight performance by reducing air resistance through additional dimple effects, there remains room for further improvement.

SUMMARY OF THE INVENTION

It is therefore an object of the present invention to provide a golf ball which, by increasing even further the aerodynamic performance due to the dimple effect, is able to considerably enhance the flight performance.

Accordingly, the invention provides a golf ball having, on a surface thereof, a plurality of circular dimples, a plurality of non-circular dimples, and a land area which is a non-dimple region composed of a plurality of arcuate first lands, each formed along an edge of one of the circular dimple, and a plurality of second lands, each arranged so as to bridge between two neighboring circular dimples and having a shape that is recessed at a center portion thereof. The non-circular dimples have an edge shape defined by a plurality of the first lands in combination with a plurality of the second lands.

It is known that the dimple surface coverage contributes to the flight performance, and that a larger surface coverage results in a better aerodynamic performance. Hence, in the golf ball of the present invention, in order to increase the dimple surface coverage, the inventors have focused on and optimized the shape of the lands, thereby enhancing the aerodynamic performance. Increasing the dimple surface coverage reduces the surface area of the lands; making the surface area of the lands smaller is an effective strategy for increasing the distance traveled by the ball. Specifically, a non-circular dimple situated between three or four mutually adjacent circular dimples has an edge shape which is defined by a plurality of the first lands in combination with a plurality of the second lands, and which increases the surface coverage of such non-circular dimples, making the surface area of the lands as small as possible.

In the invention, to avoid a shape which generates excessive aerodynamic resistance, it is desirable for the shapes of the inside corners of the non-circular dimples to be curved at a given radius of curvature. Also, in the invention, the shapes of the plurality of first lands and the plurality of the second lands formed on the surface of the ball impart the ball with a novel and unprecedented appearance, and the combination of these land shapes creates an optimal shape on the ball surface, making it possible to increase the distance traveled by the ball.

Accordingly, the invention provides the following golf balls.

[1] A golf ball comprising, on a surface thereof, a plurality of circular dimples, a plurality of non-circular dimples, and a land area which is a non-dimple region composed of a plurality of arcuate first lands, each formed along an edge of one of the circular dimples, and a plurality of second lands, each arranged so as to bridge between two neighboring circular dimples and having a shape that is recessed at a center portion thereof, wherein the non-circular dimples have an edge shape defined by a plurality of the first lands in combination with a plurality of the second lands.

[2] The golf ball of [1], wherein the first lands and the second lands have a width of from 0.05 to 1.0 mm.

[3] The golf ball of [1], wherein the land area has an outer surface which forms an outermost periphery of the ball.

[4] The golf ball of [1] wherein, at an outer peripheral edge of the non-circular dimples, junctions between the first lands and the second lands are curved, as seen from above, at a given radius of curvature.

[5] The golf ball of [1], wherein the radius of curvature of the junctions is from 0.5 to 10 mm.

[6] The golf ball of [1], wherein the ratio Vr of the sum of all dimple spaces on the ball enclosed by an outer periphery Y of the ball and dimple depressions to the volume of an imaginary sphere were the ball surface assumed to have no dimples thereon is from 1.3 to 1.7.

[7] The golf ball of [1], wherein the dimples have a depth of from 0.05 to 0.4 mm.

BRIEF DESCRIPTION OF THE DIAGRAMS

DETAILED DESCRIPTION OF THE INVENTION

The golf ball is described in detail below while referring to the attached diagrams.

Figure 1:
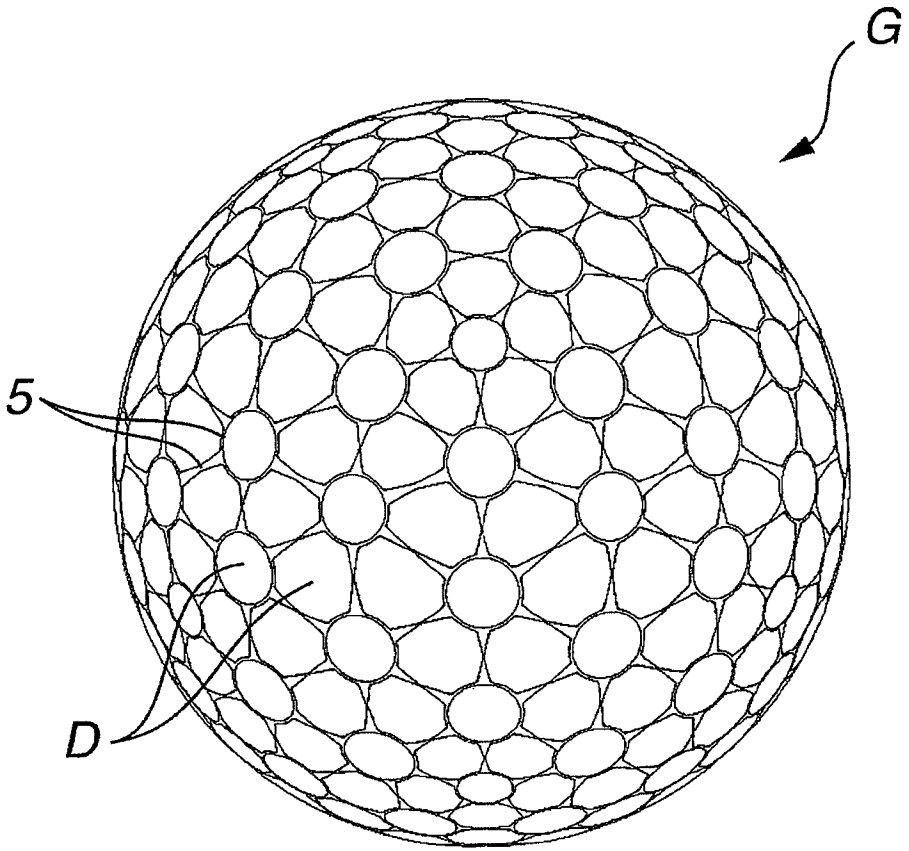
FIG. 1 is a plan view of a golf ball according to an embodiment of the invention.
Figure 2:
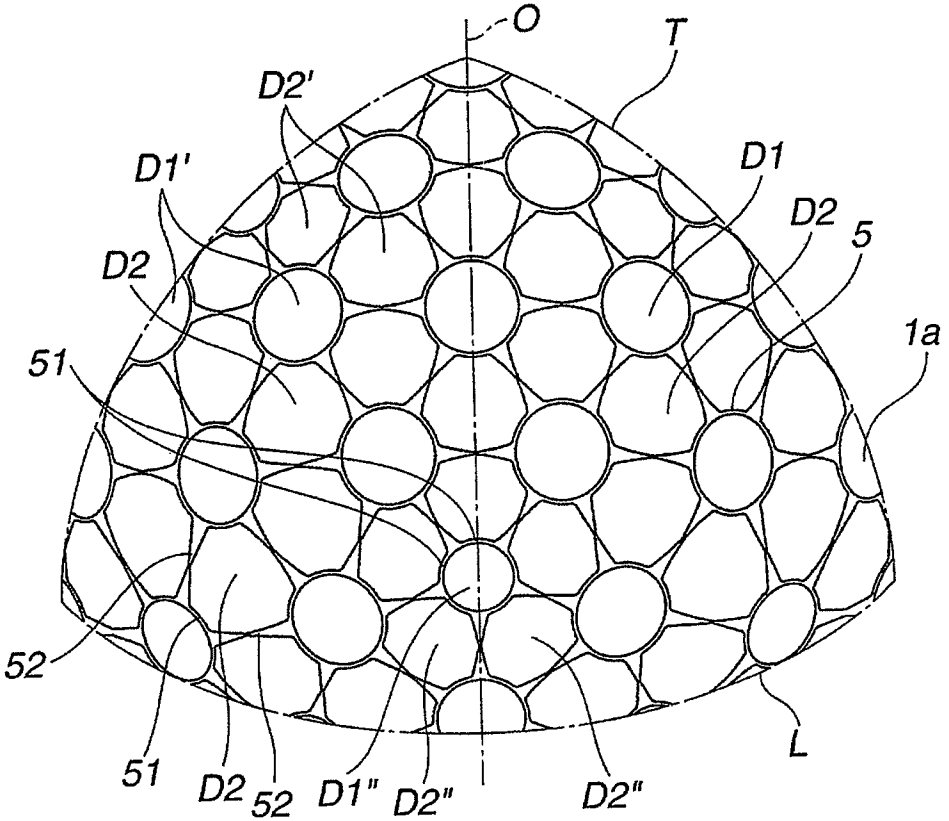
FIG. 2 is a partial enlarged view of the surface of the ball shown in FIG. 1.
Figure 3:
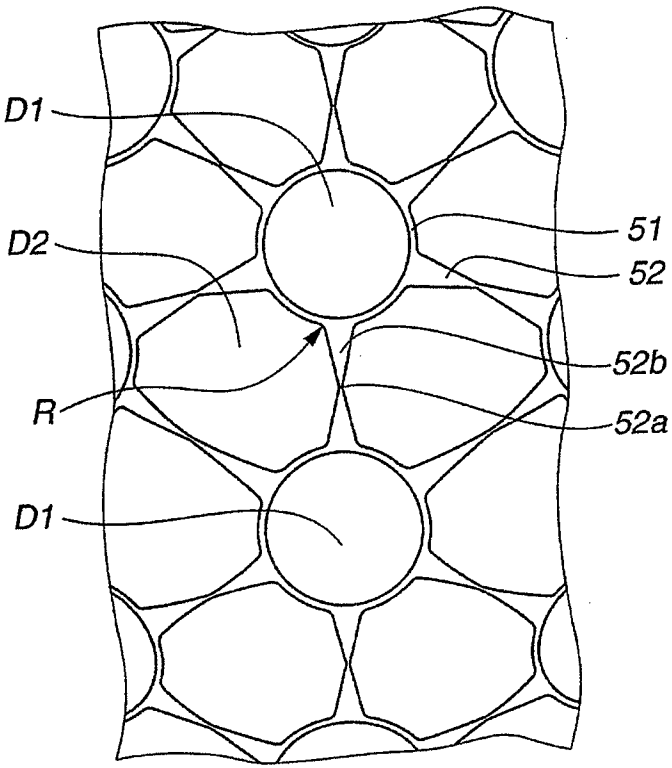
FIG. 3 is a partial enlarged view in which a portion of FIG. 2 has been further enlarged.

FIG. 1 is a plan view of a golf ball according to a first embodiment of the invention, FIG. 2 is a partial enlarged view of FIG. 1, FIG. 3 is an enlarged view of a portion of FIG. 2, and FIG. 4 shows cross-sectional views of dimples and land areas.

In the embodiment of the invention, referring to FIGS. 1 to 3, a plurality of dimples D demarcated by land areas 5 are arranged on the spherical surface of a ball. Mesh-like or grid-like land areas 5 demarcated by substantially parallel contours are present between neighboring dimples D, D. The land areas 5 have a width adjusted in a range of preferably at least 0.05 mm but not more than 1.0 mm, and more preferably at least 0.1 mm but not more than 0.8 mm. If the width of the intervals between dimples is too small, the dimples may deform readily when the ball is hit. On the other hand, if the width of the intervals is too large, the dimple surface coverage becomes smaller, resulting in a poor flight.

The land areas have a collective shape composed of ring-like lands (first lands 51), each formed along the edge of a circular dimple D1, and second lands 52, each arranged so as to bridge between two neighboring circular dimples D1, D1 and narrowly shaped with a recessed center portion. The non-circular dimples D2 have an edge shape defined by a plurality of the first lands in combination with a plurality of the second lands.

Specifically, in this embodiment, the land areas 5 are formed of five or six first lands 51 in the case of a circular dimple D1, and are formed of three first lands 51 and three second lands 52 in the case of a non-circular dimple D2. A second land 52 interposed between two non-circular dimples D2, D2 which are situated so as to be mutually adjacent is common to both dimples. At sites where a plurality of such lands unite, i.e., in this embodiment, at junctions where three land areas 5 join in a three-forked manner, as indicated by the symbol R (radius of curvature) in FIG. 3, portions which form a smooth curve, as seen from above, are included.

That is, it is preferable for inside corners of the non-circular dimples D2 to have a shape which appears as a curve when seen from above. In non-circular dimples, the shapes of ordinary inside corners do not have a smooth surface. As a result, the frictional resistance with air becomes large, keeping the ball from traveling a long distance. Hence, the corners are fashioned here as curved surfaces having a specific radius of curvature R.

This curved area does not have a specific curvature. Rather, the radius of curvature R in areas having the smallest curvature, although not subject to any particular limitation, is adjusted in a range of preferably from 0.1 to 5.0 mm, and more preferably from 1.0 to 3.0 mm.

Figure 4A:
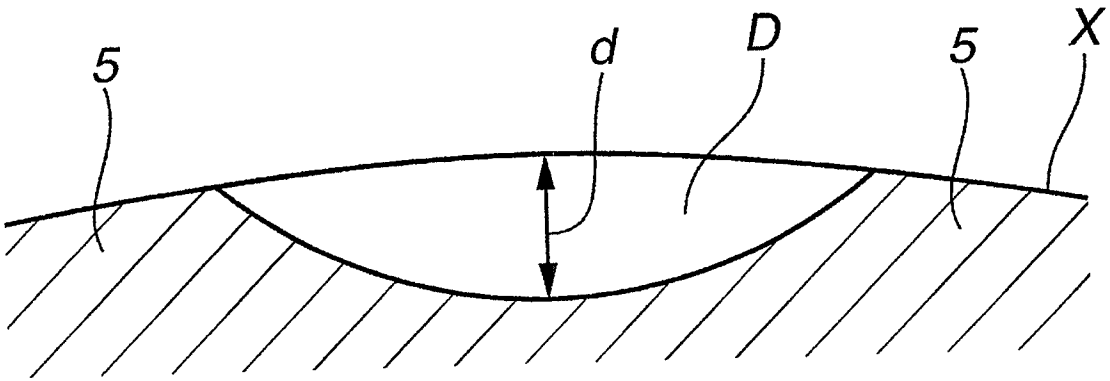
FIG. 4 shows the cross-sectional shapes of dimples and lands.
Figure 4B:
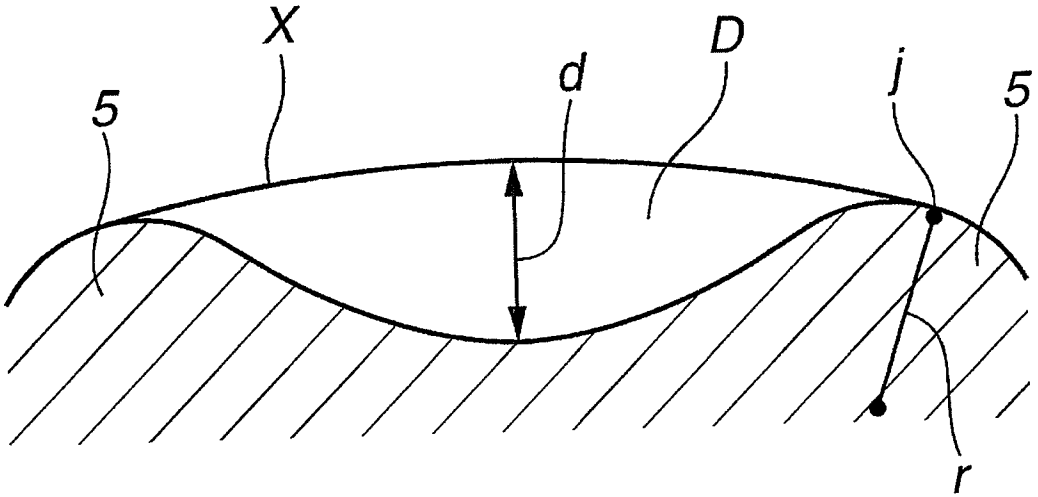
Figure 5:
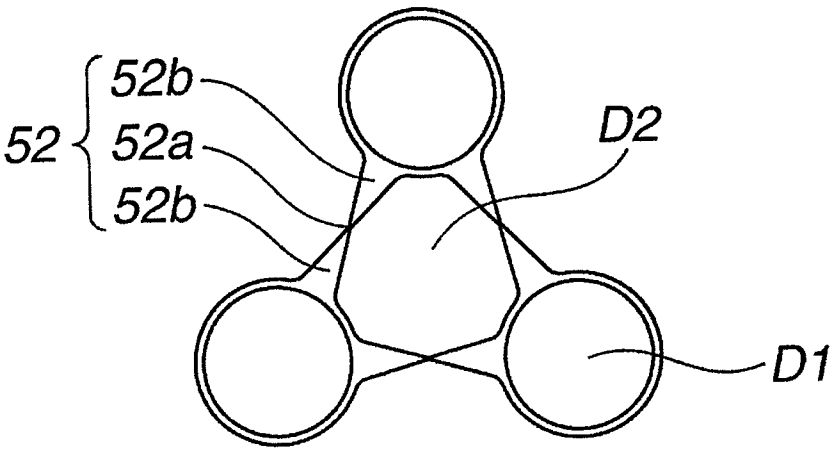
FIG. 5 shows a shape pattern I of second lands formed so as to connect three circular dimples.
Figure 6:
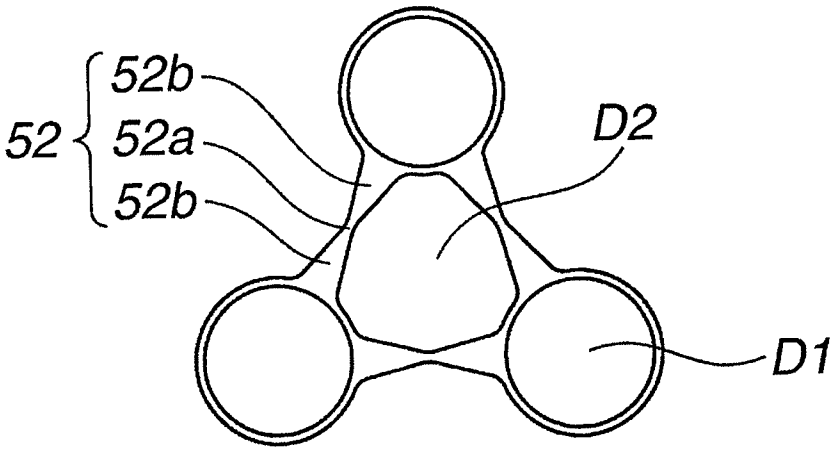
FIG. 6 shows a shape pattern II of second lands formed so as to connect three circular dimples.
Figure 7:
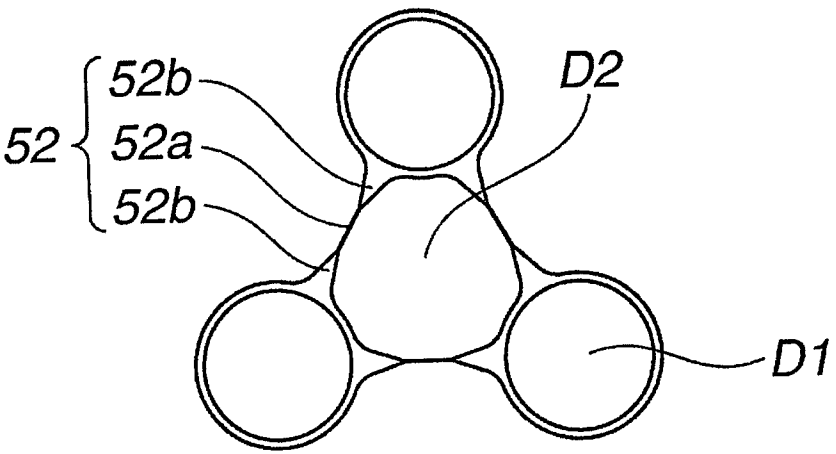
FIG. 7 shows a shape pattern III of second lands formed so as to connect three circular dimples.
Figure 8:
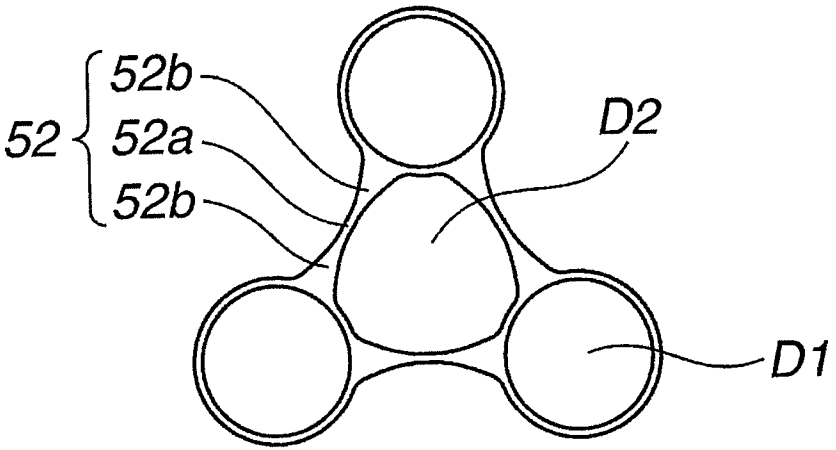
FIG. 8 shows a shape pattern IV of second lands formed so as to connect three circular dimples.
Figure 9:
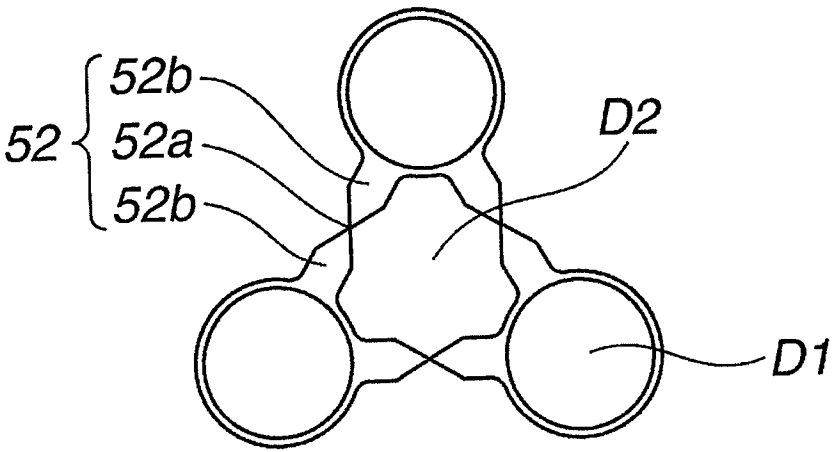
FIG. 9 shows a shape pattern V of second lands formed so as to connect three circular dimples.
Figure 10:
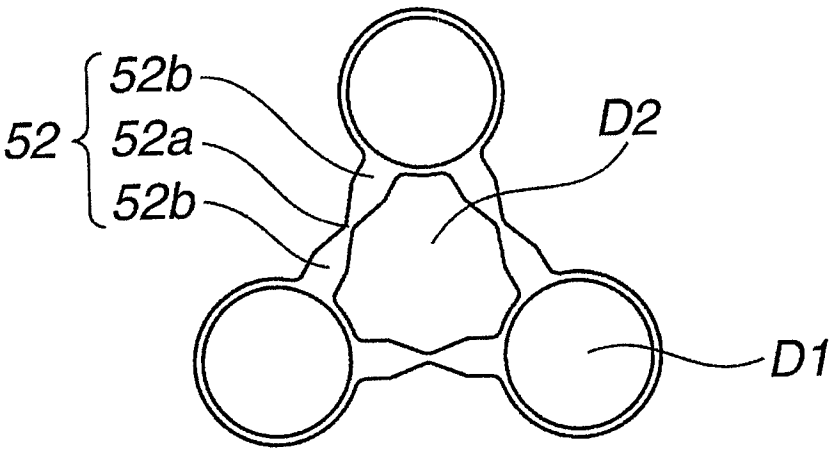
FIG. 10 shows a shape pattern VI of second lands formed so as to connect three circular dimples.
Figure 11:
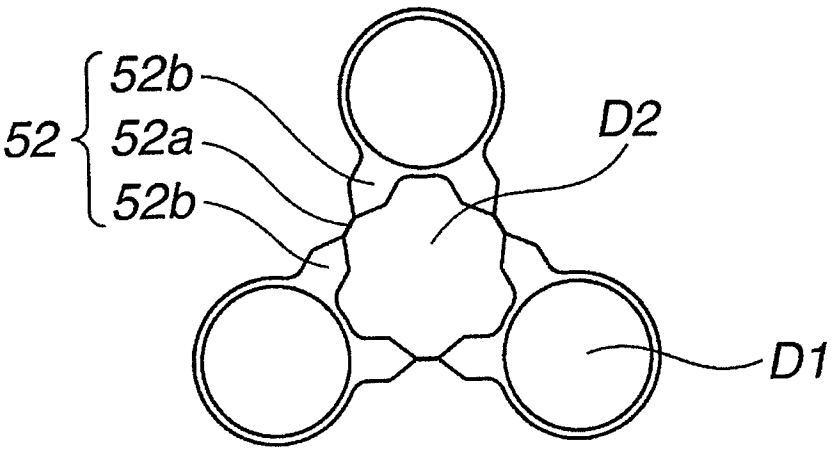
FIG. 11 shows a shape pattern VII of second lands formed so as to connect three circular dimples.
Figure 12:
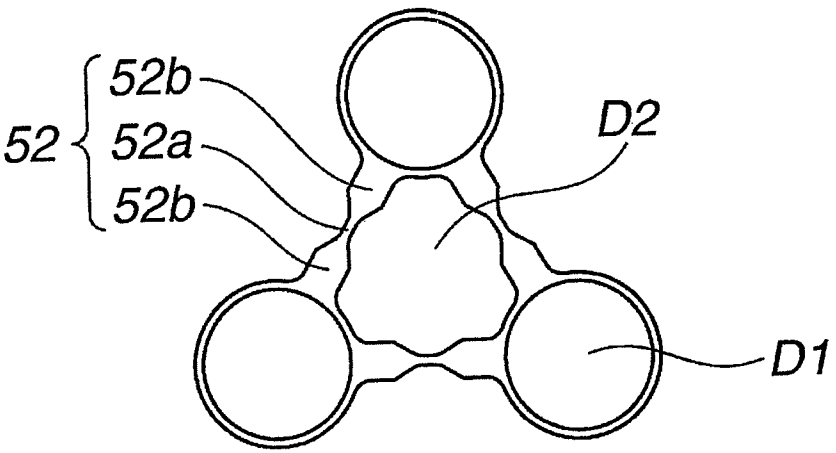
FIG. 12 shows a shape pattern VIII of second lands formed so as to connect three circular dimples.
Figure 13:
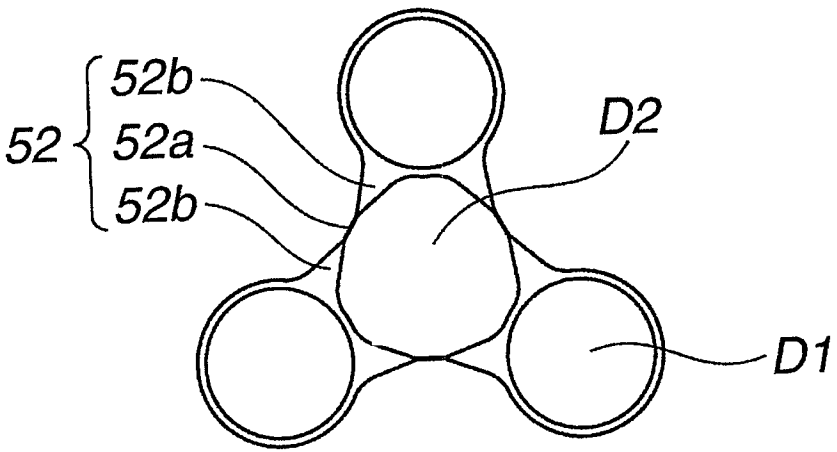
FIG. 13 shows a shape pattern IX of second lands formed so as to connect three circular dimples.
Figure 14:
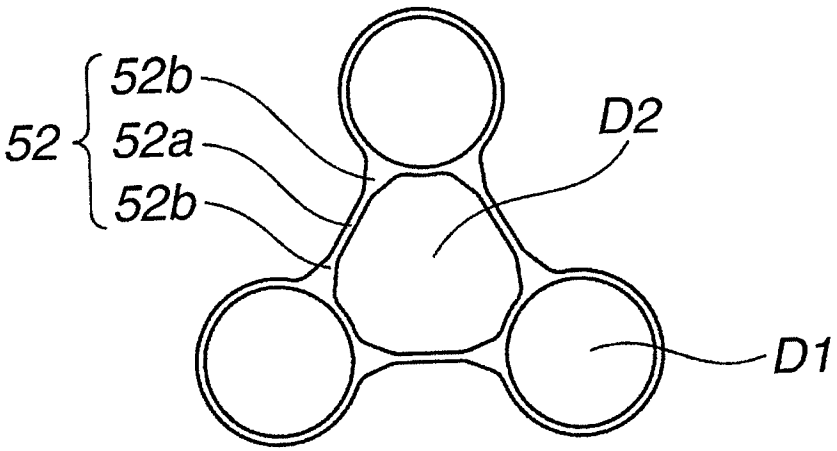
FIG. 14 shows a shape pattern X of second lands formed so as to connect three circular dimples.

Regarding the dimple cross-section in this embodiment, reference can be made to the cross-sectional view shown in FIG. 4A. The shape on the top side of a land area 5 may, as in prior-art land areas, be a shape which follows the outermost periphery X of the ball and has the same curvature as the outermost periphery, or, as shown in FIG. 4B, may have a cross-sectional shape with an apex j that protrudes outward with an arcuate curved surface toward the outside of the ball. In such a case, the arcuate cross-section has a radius r in a range of preferably from 0.2 to 5.0 mm. The depth d from the line X indicating the position of the outermost periphery of the ball to the deepest portion of the dimple is not subject to any particular limitation, but is preferably in a range of from 0.05 to 0.4 mm.

As shown in FIG. 3, each of the second lands 52 has a center portion 52*a* which is formed so as to be recessed and end portions 52*b* which are formed so as to be wide and connect to first lands 51 that follow the periphery of circular dimples D1. FIGS. 5 to 14 show specific examples of land shapes other than those in the present embodiment. A wide variety of land shapes can be created by, for example, combining a plurality of straight lines, combining curved lines having differing radii of curvature, or combining straight lines with curved lines. The shape of the second lands 52 preferably narrows gradually from the end sides thereof toward the center. By having the shape become very narrow so that the width at the center portion approaches substantially zero, the surface area occupied by the rectilinear lands is made small, in addition to which the shape of the non-circular dimples D2 enclosed by the rectilinear lands, etc. is rendered into an outwardly bulging shape. That is, the shape of the non-circular dimples D2 is rendered into a nearly circular shape and the resulting isotropy of the dimple shape eliminates differences in the directionality of the ball due to differences in the direction of ball rotation in the air, thereby making it possible to suppress lateral dispersion in the flight of the ball. Hence, the shapes in FIGS. 5 to 8 and FIGS. 13 and 14 are presented here as specific examples in which the dimple shape is more nearly circular (isotropic). By employing such dimple shapes, differences due to the directionality of the ball are suppressed, enabling lateral dispersion to be minimized.

Next, the arrangement of the dimples in this embodiment is described. Advantageous use may be made of a dimple pattern in any configuration, such as a configuration having two-fold symmetry about a pole on a hemisphere of the golf ball, a configuration with three-fold symmetry about a pole on a hemisphere of the golf ball, a configuration with four-fold symmetry about a pole on a hemisphere of the golf ball or a configuration with five-fold symmetry about a pole on a hemisphere of the golf ball. FIG. 2 is a partial enlarged view showing a spherical triangle T which is the basic unit for a configuration with three-fold symmetry about a pole O on a golf ball hemisphere. For the sake of convenience, the diagram shows only a single spherical triangle T, having included angles of 120° and enclosed by two meridians and an equator L, in which dimples are arranged.

Regarding the arrangement of dimples, circular dimples of two types—large and small—are used. Each of the large circular dimples D1' has six non-circular dimples D2' arranged around it like the petals of a flower. In this case, the non-circular dimples D2' are interposed between the two closest circular dimples D1', D1' in a common relationship with both, with the non-circular dimples D2' being arranged like the petals of a flower around the circular dimples D1'.

At the same time, relatively small circular dimples D1" and, around each, five non-circular dimples D2" are similarly arranged like the petals of a flower on a center line which connects a vertex of the unit triangle T coincident with the pole O with the center of the base of the triangle T.

In order for the land areas 5 to extend over the spherical surface without deviation, it is preferable for the dimple arrangement to be polyhedral, such as icosahedral, dodecahedral or octahedral, or for a method of arrangement such as three-fold symmetry or five-fold symmetry to be used.

In this embodiment (first embodiment), the total number of dimples is 326, of which 216 are non-circular dimples and the remaining 110 are circular dimples. Here, the number of non-circular dimples as a proportion of the total number of dimples is 66.3%. When the dimples are composed in this way of non-circular dimples and circular dimples, the proportion of the total number of dimples which are non-circular dimples is preferably from 50 to 75%, and more preferably form 55 to 75%.

The total number of dimples D formed on the ball surface. although not subject to any particular limitation, is preferably at least 100, and more preferably at least 250. The upper limit is preferably not more than 500, and more preferably not more than 450.

The proportion of the total volume of the ball occupied by the dimple spaces is explained while referring to FIG. 4. The ratio of the sum of the dimple spaces enclosed by an outer periphery X of the ball and the dimple depressions to the volume of an imaginary sphere were the ball surface assumed to have no dimples thereon (dimple spatial occupancy Vr) is typically set to at least 1.1%, preferably at least 1.2%, more preferably at least 1.3%, and even more preferably at least 1.4%. The upper limit is typically set to not more than 1.7%, preferably not more than 1.65%, and more preferably not more than 1.6%. By setting this dimple spatial occupancy within the above range, when the ball is struck with a distance club such as a driver, the shot can be prevented from rising too steeply or from dropping and not gaining enough height.

To fabricate a mold (a two-part type mold) for molding the golf ball of the invention, a technique may be employed in which 3D CAD/CAM is used to directly cut the entire surface shape three-dimensionally into a master mold from which the golf ball mold is subsequently made by pattern reversal, or to directly cut three-dimensionally the cavity (inside walls) of the golf ball mold.

Trimming can be made easier by having the parting line between the top and bottom halves of the mold which forms along the equator L of the spherical cavity pass through the highest points of land areas 5.

Figure 15:
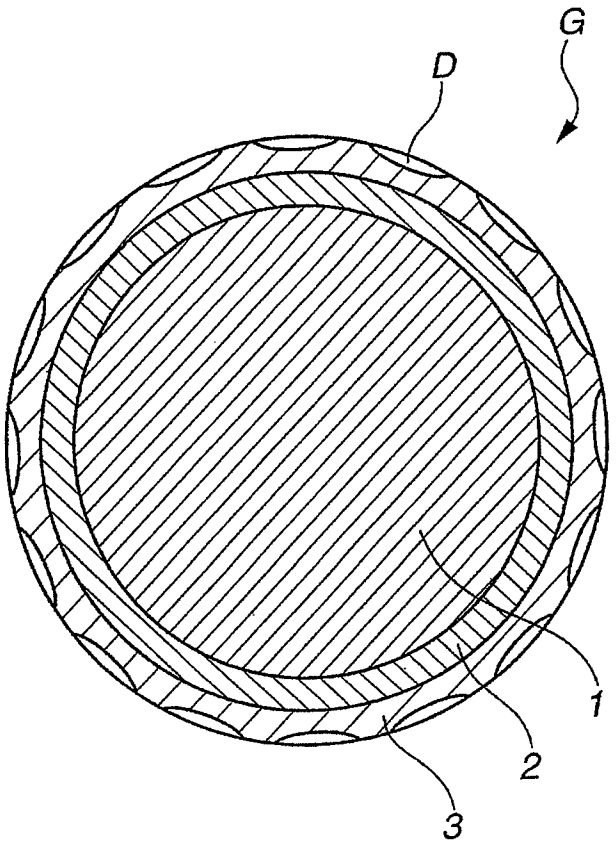
FIG. 15 is a sectional view showing the internal structure of the golf ball used in the example of the invention.

The golf ball of the invention is not subject to any particular limitation with regard to ball construction. That is, the present art may be applied to any type of golf ball, including solid golf balls such as one-piece golf balls, two-piece golf balls, and multi-piece golf balls having a construction of three or more layers, and also wound golf balls. The use of a multilayer construction having, as shown in FIG. 15, a resilient solid core, a cover, and one or more intermediate layer situated therebetween is especially preferred. In FIG. 15, the symbol 1 represents the resilient core, the symbol 2 represents the intermediate layer, and the symbol 3 represents the cover.

In the golf ball G shown in FIG. 15, the resilient core 1 is composed primarily of polybutadiene and has a hardness such that, when the solid core is compressed under a load of 1,274 N (130 kgf) from an initial load state of 98 N (10 kgf), the deflection, although not subject to any particular limitation, is at least 2.0 mm, and preferably at least 2.5 mm, but not more than 4.5 mm, and preferably not more than 4.0 mm.

A known thermoplastic resin, particularly an ionomeric resin or a urethane resin, may be used as the material of intermediate layer 2 or the cover 3. The use of an ionomeric resin is especially preferred.

The cover has a Shore D hardness which, although not subject to any particular limitation, from the standpoint of the spin rate and rebound is typically at least 45, and preferably at least 50, but typically not more than 75, and preferably not more than 63.

The intermediate layer has a Shore D hardness which, although not subject to any particular limitation, from the standpoint of the spin rate and rebound is typically at least 45, and preferably at least 50, but typically not more than 70, and preferably not more than 60.

The cover thickness and the intermediate layer thickness, although not subject to any particular limitation, are preferably set to from 0.3 to 1.5 mm. Ball specifications such as the ball weight and diameter may be suitably set in accordance with the Rules of Golf.

As described above, in the golf ball of the invention, by rendering the lands on the ball surface into a unique shape, the surface area of the lands is minimized and the dimple surface coverage is made even larger, increasing the aerodynamic performance and thus enabling the ball to travel even farther.

EXAMPLES

Examples of the invention and Comparative Examples are given below by way of illustration, although the invention is not limited by the following Examples.

Example and Comparative Examples

Figure 16:
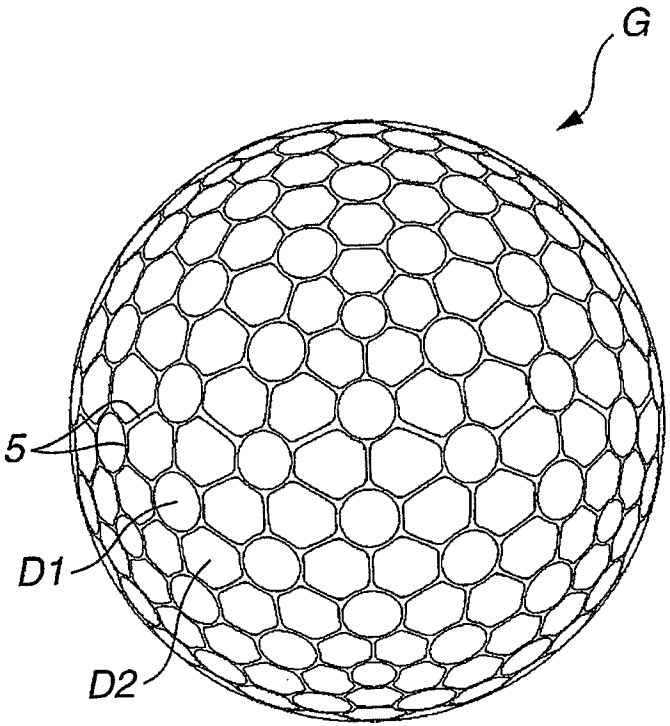
FIG. 16 is a plan view of the golf ball of Comparative Example 1.
Figure 17:
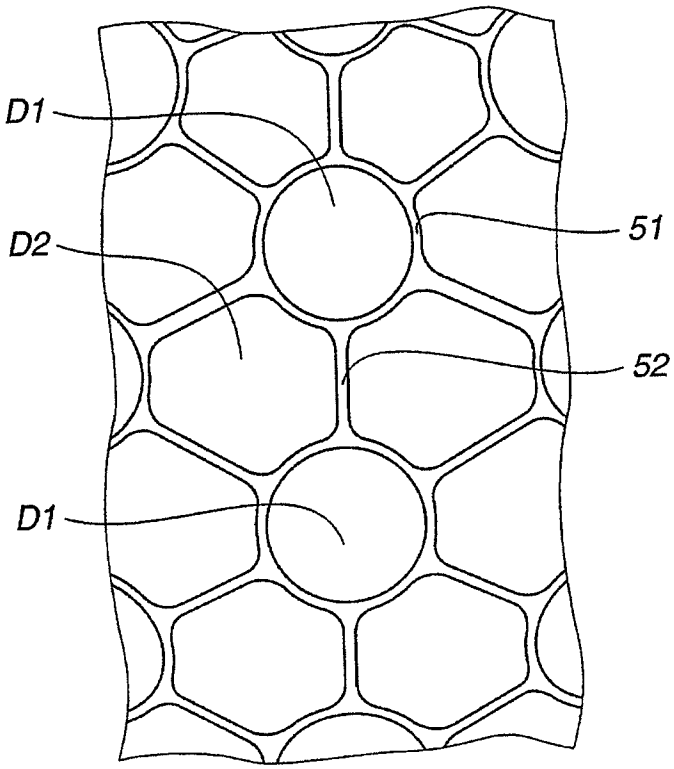
FIG. 17 is a partially enlarged view showing the shapes of the dimples and lands in FIG. 16.
Figure 18:
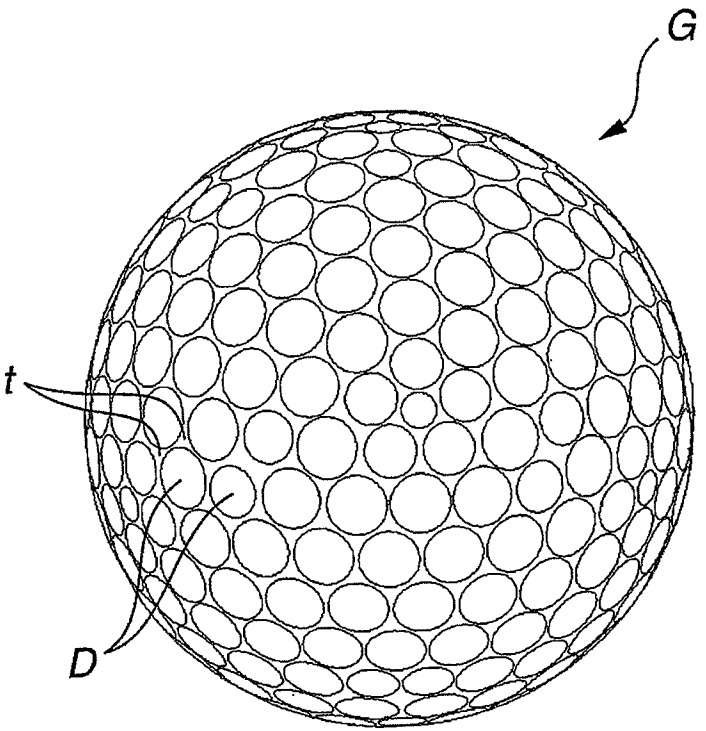
FIG. 18 is a plan view of a conventional golf ball (Comparative Example 2) having arranged thereon a plurality of only circular dimples.
Figure 19:
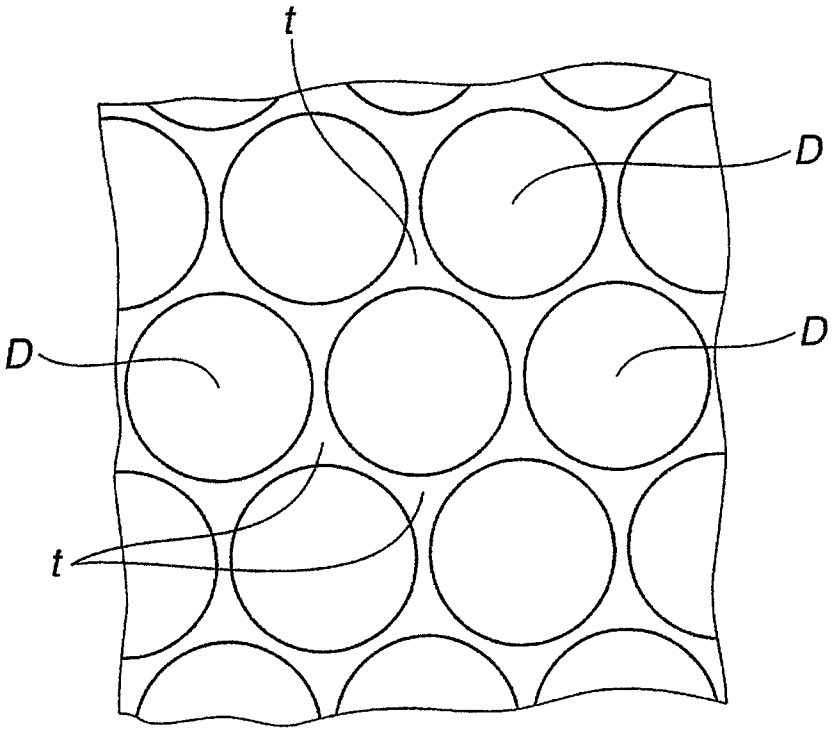
FIG. 19 is a partial enlarged view showing the shapes of the dimples and lands in FIG. 18.

Using golf balls having the dimple arrangements shown in FIG. 1 (Example 1), FIG. 16 (Comparative Example 1) and FIG. 18 (Comparative 2), comparison tests were performed on the flight characteristics of these golf balls. The dimple configurations in all these examples (Example 1 and Comparative Examples 1 and 2) were based on an arrangement having three-fold symmetry about the pole on a hemisphere of the ball.

With regard to the interior construction of the golf balls in these respective examples, as shown in FIG. 15, the ball G had a three-piece construction composed of a core 1, a cover 3 and one intermediate layer 2. The details are given below.

Core

Use was made of 100 parts by weight of polybutadiene (available from JSR Corporation under the trade name BR730), 33.8 parts by weight of zinc acrylate, 3.0 parts by weight of a mixture of 1,1-di(t-butylperoxy)cyclohexane and silica (available from NOF Corporation under the trade name Perhexa C-40), 0.1 part of sulfur, 25.7 parts of zinc oxide and 1.5 parts of the zinc salt of pentachlorothiophenol. A core material composed of these ingredients was vulcanized in a core-forming mold at a vulcanization temperature of 157° C. for a vulcanization time of 15 minutes, thereby producing solid cores for each of the examples. The core hardness, as obtained by measuring the deflection when compressed under a final load of 130 kgf from an initial load of 10 kgf (10-130 kgf hardness), was 3.7 mm.

Intermediate Layer and Cover

Next, the intermediate layer was injection-molded in a mold in which the above solid core had been set, following which the cover was injection-molded in a mold in which the sphere composed of the core encased by the intermediate layer had been similarly set. The intermediate layer material was a blend composed of AM7331 (an ionomeric resin available from DuPont-Mitsui Polychemicals Co., Ltd.), Dynaron E6100P (a block copolymer polybutadiene hydrogenate available from JSR Corporation), behenic acid (NOF Corporation) and calcium hydroxide in a weight ratio of 85/15/20/2.9. The cover material was a blend composed of AM7311, Himilan 1557, Himilan 1605, Himilan 1855 and calcium hydroxide in a weight ratio of 15/35/35/15/2.7. The Shore D hardnesses of the intermediate layer and the cover were respectively 51 and 59.

Ball Tests

Distance measurements were carried out on the resulting golf balls. In the tests, the distance traveled by the ball when struck with a driver (W#1) mounted on a golf swing robot was measured. The striking conditions were set as follows: initial ball velocity, about 65 m/s; launch angle, about 10°; initial backspin, about 2,800 rpm. The club used was a TourStage X-Drive 701 (loft angle, 9°) manufactured by Bridgestone Sports Co., Ltd. The measured results are shown in Table 1. The dimple surface coverage (SR) of a ball is the ratio of the sum of the surface areas on the surface of an imaginary sphere, were the ball assumed to have no dimples thereon, which are enclosed by the edges of the respective dimples to the surface area of the imaginary sphere.

TABLE 1

| | | Example | Comparative Example | |
|---|---|---|---|---|
| | | 1 | 1 | 2 |
| Dimple configuration | | FIG. 1 | FIG. 16 | FIG. 18 |
| Number of dimples | Non-circular | 216 | 216 | — |
| | Circular | 110 | 110 | 330 |
| | Total | 326 | 326 | 330 |
| Dimple coverage (%)[1)] | | +10 | +7 | — |

TABLE 1-continued

| | | Example | Comparative Example | |
|---|---|---|---|---|
| | | 1 | 1 | 2 |
| Test results | Carry (m) | 221.7 | 219.2 | 216.5 |
| | Total distance (m) | 231.1 | 228.1 | 225.2 |
| | Left-right dispersion (right positive: m)[2)] | −1.4 | −2.8 | −0.9 |

[1)]The dimple coverage is expressed as the percent increase relative to the value for Comparative Example 2.

[2)]The left-right dispersion, i.e., the ball isotropy, was evaluated. Values are expressed as the distance (mean) that the ball deviated to the right from a directrix.

As shown in Table 1, the golf ball of Example 1 according to the invention was able to increase the dimple surface coverage by 10% compared with the golf ball of Comparative Example 2, which had conventional dimples made up entirely of circular dimples, and was able to increase the dimple surface coverage by 3% compared with the golf ball of Comparative Example 1, which had equal numbers of circular dimples and non-circular dimples. As a result, the golf ball of Example 1 exhibited a large increase in distance compared with Comparative Examples 1 and 2, and the isotropy of the ball was good.

The invention claimed is:

1. A golf ball comprising, on a surface thereof, a plurality of circular dimples, a plurality of non-circular dimples, and a land area which is a non-dimple region composed of a plurality of arcuate first lands, each formed along an edge of one of the circular dimples, and a plurality of second lands, each arranged so as to bridge between two neighboring circular dimples and having a shape that is recessed at a center portion thereof, wherein the non circular dimples have an edge shape defined by a plurality of the first lands in combination with a plurality of the second lands, wherein the shape of the non-circular dimples is configured such that when a virtual triangle is drawn such that each of the vertexes of the virtual triangle are placed inside each of mutually neighboring three circular dimples respectively, of the circular dimple edge within around the vertexes of the virtual triangle define the first land, together with an arc of the non-circular dimple formed opposite the edge of the circular dimple, and rectilinear or curve lines which connect an edge of one arc with an edge of another arc define a second land between adjacent non-circular dimples and are formed so as to bulge outwardly beyond the middle point of each side of the virtual triangle.

2. The golf ball of claim 1, wherein the first lands and the second lands have a width of from 0.05 to 1.0 mm.

3. The golf ball of claim 1, wherein the land area has an outer surface which forms an outermost periphery of the ball.

4. The golf ball of claim 1 wherein, at an outer peripheral edge of the non-circular dimples, junctions between the first lands and the second lands are curved, as seen from above, at a given radius of curvature.

5. The golf ball of claim 1, wherein the radius of curvature of the junctions is from 0.5 to 10 mm.

6. golf ball of claim 1, wherein the ratio Vr of the sum of all dimple spaces on the ball enclosed by an outer periphery Y of the ball and dimple depressions to the volume of an imaginary sphere were the ball surface assumed to have no dimples thereon is from 1.3 to 1.7.

7. The golf ball of claim 1, wherein the dimples have a depth of from 0.05 to 0.4 mm.

8. The golf ball of claim 1, wherein the second lands have a symmetrical shape.

9. The golf ball of claim 1, wherein opposing sides of each of the second lands are defined by a non-circular dimple.

10. The golf ball of claim 1, wherein each of the second lands taper linearly from a portion adjacent one of the circular dimples to the center portion.

11. The golf ball of claim 1, wherein each edge of the second lands extend between the two neighboring circular dimples comprise a plurality of nonparallel linear portions.

12. The golf ball of claim 1, wherein the shape of the non-circular dimples is rendered into an outwardly bulging shape around the second lands.

13. The golf ball of claim 1, wherein the proportion of the non-circular dimples to the total number of dimples is from 50 to 75%.

14. The golf ball of claim 1, wherein the shape of the second lands narrows gradually from the end sides thereof toward the center and the shape become narrow so that the width at the center portion approaches substantially zero.

* * * * *